United States Patent [19]

Malhotra et al.

[11] Patent Number: 4,606,817

[45] Date of Patent: Aug. 19, 1986

[54] RECOVERY OF MOLYBDENITE

[75] Inventors: Deepak Malhotra; Robert M. Rowe, both of Arvada; Anirudh K. Bhasin, Golden, all of Colo.

[73] Assignee: Amax Inc., Greenwich, Conn.

[21] Appl. No.: 696,984

[22] Filed: Jan. 31, 1985

[51] Int. Cl.[4] ..... B03D 1/02

[52] U.S. Cl. ..... 209/166

[58] Field of Search ..... 209/166, 167; 75/2; 252/61

[56] References Cited

U.S. PATENT DOCUMENTS 3,313,412 4/1967 Bloom et al. ..... 209/167

4,268,380 5/1981 Shaw ..... 209/167

4,515,688 5/1985 Vargas ..... 209/167

*Primary Examiner*—Bernard Nozick

*Attorney, Agent, or Firm*—Michael A. Ciomek; Eugene J. Kalil

[57] ABSTRACT

Directed to a flotation process for recovering molybdenite from a ground ore pulp containing the same which includes a rougher flotation step in which no collector is used by relatively high recovery of molybdenite in a rougher concentrate uncontaminated with collectors, which rougher concentrate can be cleaned to yield a high grade product while the rougher tailing can be treated by flotation to obtain high overall recovery of molybdenite along with a high recovery of other co-present metal values.

7 Claims, 1 Drawing Figure

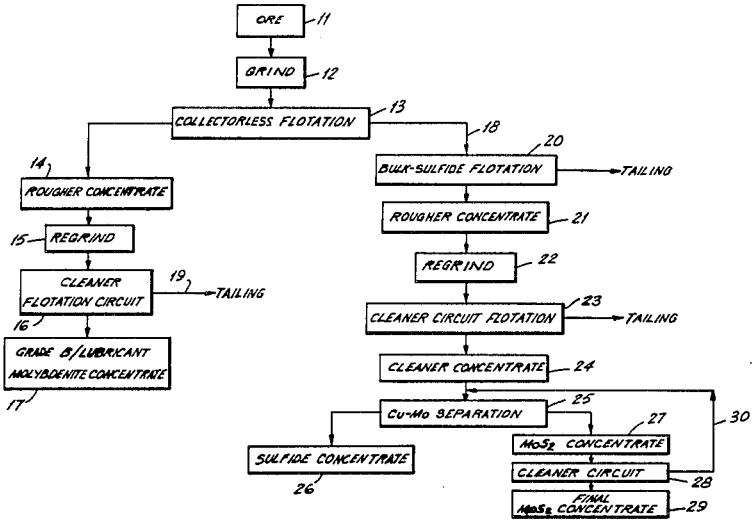

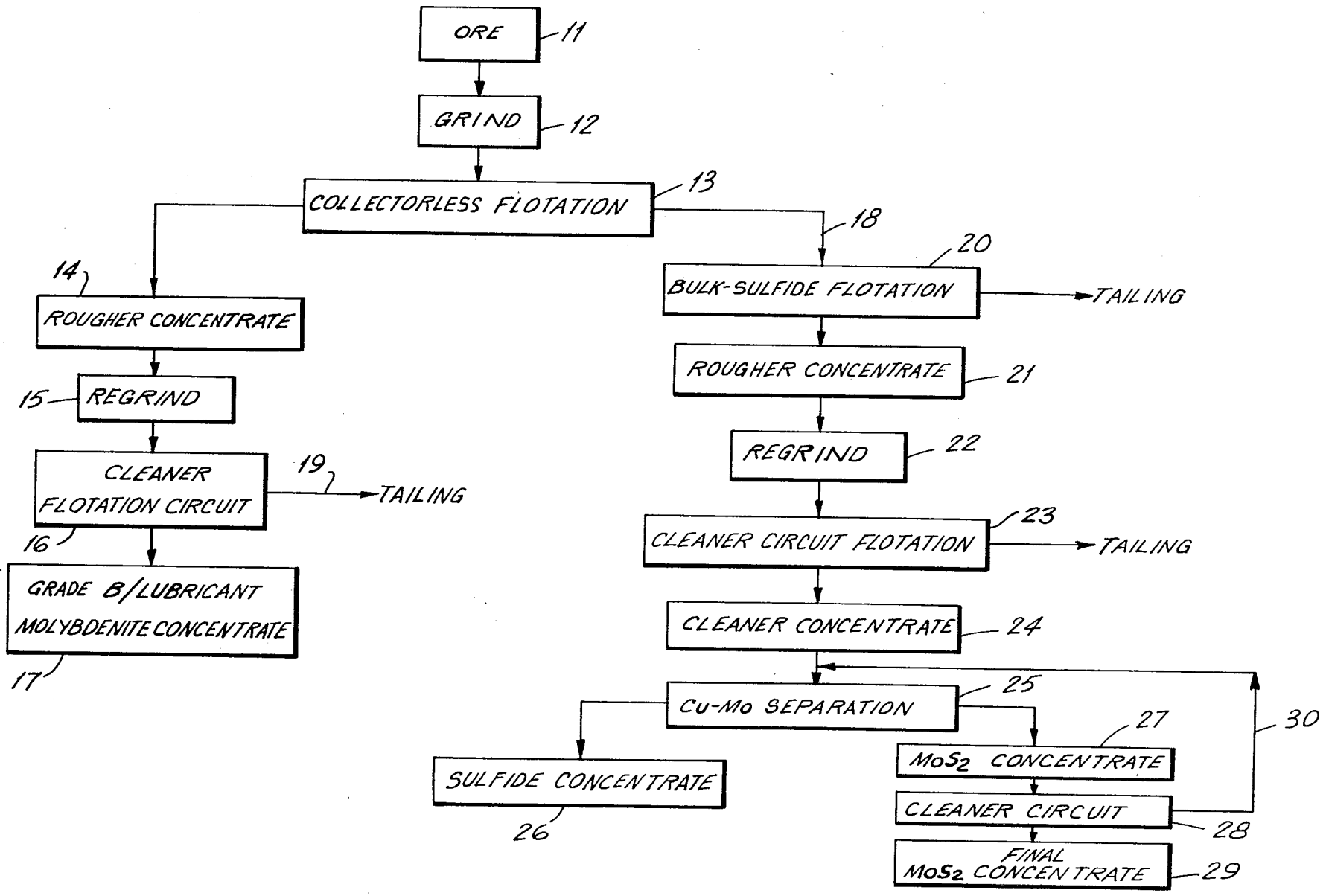
ORE
11
GRIND
12
COLLECTORLESS FLOTATION
13
18
BULK-SULFIDE FLOTATION
20
TAILING
ROUGHER CONCENTRATE
21
REGRIND
22
CLEANER CIRCUIT FLOTATION
23
TAILING
CLEANER CONCENTRATE
24
Cu-Mo SEPARATION
25
30
MoS2 CONCENTRATE
27
CLEANER CIRCUIT
28
FINAL MoS2 CONCENTRATE
29
SULFIDE CONCENTRATE
26
ROUGHER CONCENTRATE
14
REGRIND
15
CLEANER FLOTATION CIRCUIT
16
19
TAILING
GRADE B/LUBRICANT MOLYBDENITE CONCENTRATE
17

RECOVERY OF MOLYBDENITE

The invention is directed to a flotation process for recovering molybdenite from an ore containing the same wherein a high recovery of molybdenite is maintained along with improvements in grade of molybdenite concentrates as compared to conventional processes.

BACKGROUND OF THE INVENTION AND THE PRIOR ART

Molybdenite (molybdenum disulfide, $MoS_2$) is the most important source of the metal, molybdenum. The mineral occurs, usually, in low concentration along with other metal sulfide minerals such as those of iron and copper. Vexing problems have arisen in working up ores containing molybdenite since in many cases, the primary metal value sought to be recovered is another base metal such as copper, with the molybdenite content being so low that, in many cases, it is regarded as a byproduct. Known molybdenite flotation practices can be classified into two major classes; namely: (1) selective flotation of molybdenite and (2) bulk sulfide flotation. Selective flotation is generally used by primary producers of molybdenum and is generally applied in cases where molybdenite is the primary mineral of interest in the ore being treated while bulk sulfide flotation is generally employed in byproduct or coproduct recovery of molybdenite in conjunction, usually, with primary copper recovery.

As implied by the names, selective flotation involves floating molybdenite selectively from the ground ore while other sulfide minerals and gangue ore are depressed in the same step. The grind employed may be relatively coarse, e.g., 35% to 40% plus 100 mesh, the reagent suite required is complex and expensive, the process is not suited to recovery of byproducts and/or coproducts but product quality is excellent. Reagents employed include collectors such as a refined petroleum oil ("vapor oil" or diesel oil), frothers or conditioners such as syntex (sulfated glyceride of coconut oil), pine oil, depressers such as sodium silicate, sodium cyanide or Nokes reagent (see U.S. Pat. No. 2,492,936).

Bulk sulfide flotation involves floating all the sulfides contained in the ore to produce a bulk concentrate which must then be treated further to separate molybdenite from other sulfide values such as copper. This is usually done in a flotation operation in which the sulfides of copper and other metals present are depressed and the molybdenite is floated with a collector, e.g., an oil. The molybdenite is further cleaned to produce a commercial grade concentrate while the tailing is further treated by flotation to produce concentrates of copper and other co-present values. Usually a fine grind is required, e.g., 15 to 20% plus 100 mesh, and multistage flotation circuits are required. Concentrate grade tends to be lower and leaching may be required to remove lead, copper or iron to produce a marketable-grade product.

It should also be mentioned that when an oil is used as a collector for molybdenite, the resulting concentrate will contain substantial quantities of oil, e.g., up to as much as 10% by weight. Such quantities of oil cause problems in many downstream operations such as roasting. Thus, even though oil may be used in quite small amounts based upon weight of ore treated, these amounts of oil are still substantial in terms of molybdenite content of the ore, which may be, for example, only 0.3% by weight, or much less.

Those skilled in the art are aware that once a mineral surface has been treated to depress the mineral using a depressing agent, the effect of the depressing agent must be overcome before the mineral can be floated successfully in later flotation operation. Many means for accomplishing this have been suggested in the art, but all involve multiple treatments and many suggest complex flotation circuits and use of many different reagents for different purposes. Patents dealing with the problems discussed include U.S. Pat. Nos. 2,559,104; 2,608,298; 2,664,199; 2,811,255; 2,957,576; 3,102,854; 3,313,412; 3,329,266; 3,375,924; 3,400,817; 3,435,952, 3,539,002. U.S. Pat. No. 3,082,065 deals with the problem of grinding wet, oily molybdenite concentrate to produce a dry lubricant using a fluid energy reduction mill.

The process of the present invention addresses the problem of providing an improved process for treating a molybdenite ore to provide an increased yield of molybdenite suitable for lubricant purposes, reduce reagent costs and facilitate recovery of byproducts from the ore.

BRIEF SUMMARY OF THE INVENTION

The invention contemplates floating molybdenite from a comparatively coarsely ground pulp of molybdenite ore using only a small amount of frother but no collector to produce a molybdenite concentrate essentially devoid of collector, e.g., oil, contamination which concentrate is then cleaned, after any necessary regrinding, in a cleaner circuit while the tailing from the collectorless flotation operation is subjected to bulk sulfide flotation to yield a bulk sulfide concentrate which is worked up to recover remaining molybdenite and other sulfide values contained in the ore.

BRIEF DESCRIPTION OF THE DRAWING

The drawing is a flowsheet showing a preferred circuit for carrying out the present invention.

DETAILED DESCRIPTION OF THE INVENTION

The invention will now be described in conjunction with the drawing in which reference character 11 depicts a starting molybdenite ore which may contain, by weight, about 0.05% to about 0.5% molybdenite, about 0.5% to about 4.0% $FeS_2$, at least one metal sulfide from the group consisting of up to about 0.2% lead sulfide, up to about 0.2% copper sulfide, up to about 0.2% zinc sulfide and up to about 0.5 oz. per ton silver. The ore is wet ground to 12 to produce a pulp containing about 30% to about 40%, by weight, solids, which is fed to collectorless flotation 13 in the presence of a small amount of frother. A relatively coarse grind of about 20% to about 40% plus 100 mesh, e.g., about 30% to about 40% plus 100 mesh may be used. Up to 0.1 pounds per ton of pine oil or an equivalent amount of another frother such as methyl isobutyl carinol, Dowfroth 250 or Aerofrothers may be used. Flotation 13 may be regarded as a rougher operation with the rougher concentrate 14, which now contains most of the molybdenite present in feed ore 11, being reground, if necessary, in regrind operation 15 to a grind corresponding to a cumulative percentage of about 1–2% on a 100 mesh screen and then cleaned at 16 in the cleaner flotation circuit. The product from cleaner circuit 16 is a high grade molybdenite 17 containing at least about 98% $MoS_2$, less than 0.05% copper and less than about 2% $SiO_2$ and hence meets the requirements of Grade B molybdenite concentrate. Grade B concentrate is premium grade molybdenite concentrate suitable for dry lubricant purposes.

The rougher tailing 18 and cleaner tailing 19 are combined, conditioned with flotation oil and/or xanthate collector and subjected to bulk-sulfide flotation 20 to recover a rougher concentrate 21 containing remaining molybdenite and other sulfides such as pyrite ($FeS_2$) and sulfides of lead, copper, zinc, slver, etc., originally present in the ore. Bulk-sulfide rougher concentrate 21 is reground, if necessary, at 22 to a grind corresponding to a cumulative percentage of 10–15% plus 100 mesh to liberate sulfides. The reground concentrates are floated again in cleaner circuit 23 to yield cleaner concentrate 24 which is subjected to Cu-Mo separation 25 to yield sulfide concentrate 26 and $Mos_2$ concentrate 27. The $MoS_2$ concentrate may be cleaned in cleaner circuit 28 to provide a final $MoS_2$ concentrate 29. Tailings 30 from cleaner operation 28 are returned to Cu-Mo separation 25. Final $MoS_2$ concentrate 29 is found to meet specifications for regular grade $MoS_2$ concentrate which requires at least about 90% $MoS_2$, no more than about 0.1% copper and no more than about 7% silica.

Examples will now be given:

Sixteen 2-kilogram ore samples assaying 0.3% $MoS_2$, 2.2% $FeS_2$, 0.007% Cu, 0.003% Pb, 0.012% Zn, and 0.03 oz/ton silver were ground individually at 60% solids in a rod mill to a grind of 35 cumulative weight percent plus 100 mesh. The ground pulp was transferred to a 1,000 gram cell and floated at 35% solids with a Denver D-1 flotation machine. In each case the pulps were conditioned only with 0.04 lb/ton pine oil and pH was adjusted to pH8 with lime. Average results for the sixteen tests are given in the following Table 1 for 2-minute flotation time.

TABLE 1

Metallurgical Results for Collectorless Flotation

| Process Stream | Recovery, Percent Weight | Recovery, Percent $MoS_2$ | Grade, Percent $MoS_2$ |
|---|---|---|---|
| Feed | 100.0 | 100.0 | 0.30 |
| Rougher Concentrate | 1.25 | 76.8 | 18.43 |
| Rougher Tailing | 98.75 | 23.2 | 0.070 |

The rougher flotation tailing in several tests was conditioned with vapor oil and/or a sulfide collector and a bulk sulfide collected. Metallurgical results are presented in Table 2.

TABLE 2

Metallurgical Results for Bulk-Sulfide Flotation

| Test No. | Reagents, lb/t Vapor Oil | Reagents, lb/t Syntex | Reagents, lb/t Mercaptan Pennfloat 3 | Reagents, lb/t Xanthate 350 | Bulk Sulfide Concentrate Recovery, Percent Weight | Bulk Sulfide Concentrate Recovery, Percent $MoS_2$ | Bulk Sulfide Concentrate Grade, Percent $MoS_2$ | Tailing Percent $MoS_2$ |
|---|---|---|---|---|---|---|---|---|
| 100 | 0.20 | 0.005 | — | — | 2.5 | 11.3 | 1.47 | 0.037 |
| 102 | — | — | 0.20 | — | 5.5 | 16.5 | 1.00 | 0.021 |
| 108 | — | — | — | 0.20 | 3.8 | 12.7 | 1.10 | 0.033 |
| 109 | 0.20 | 0.005 | 0.20 | — | 5.1 | 15.4 | 1.00 | 0.024 |
| 115 | 0.20 | 0.005 | — | 0.20 | 4.7 | 13.2 | 0.73 | 0.031 |

Conditions:
Flotation Feed: 0.070% $MoS_2$
Flotation Time: 4 minutes
Flotation pH: 8 (adjusted with lime)

The results of Tables 1 and 2 indicate an overall recovery of molybdenite between about 88 and about 93 percent.

EXAMPLE 2

A rougher concentrate assaying 18.4 percent $MoS_2$ (step 14) produced in the collectorless flotation stage, was subjected to three stages of regrinding and five stages of cleaner flotation in open-circuit bench-scale test work.

The test results presented in Table 3, show the product to meet impurity specifications for Grade B molybdenite concentrate.

Also, the bulk-sulfide concentrate was upgraded using two stages of regrinding and three stages of cleaner flotation (steps 22 to 29) to produce a molybdenite concentrate product. The results, presented in Table 4, show the product to meet impurity specifications for regular-grade molybdenite concentrate.

TABLE 3

Metallurgical Results for Upgrading Collectorless Flotation Rougher Concentrate

| Process Stream | Recovery, Percent Weight | Recovery, Percent $MoS_2$ | Grade, Percent $MoS_2$ |
|---|---|---|---|
| Rougher Concentrate | 100.0 | 100.0 | 18.4 |
| Grade B Molybdenite Concentrate | 18.3 | 96.8 | 97.5 |
| Cleaner Tailing | 81.7 | 3.2 | 0.72 |

Grade B. molybdenite concentrate assayed 0.28 percent $FeS_2$, 0.09 percent Cu, and 1.9 percent silica.

TABLE 4

Metallurgical Results for Upgrading Bulk-Sulfide Rougher Concentrate

| Process Stream | Recovery, Percent Weight | Recovery, Percent $MoS_2$ | Grade, Percent $MoS_2$ |
|---|---|---|---|
| Rougher Concentrate | 100.0 | 100.0 | 1.00 |
| Regular Grade Conc. | 1.1 | 88.0 | 93.0 |
| Cleaner Tailing | 98.9 | 12.0 | 0.12 |

Regular-grade molybdenite concentrate assayed 2 percent $FeS_2$, 0.15 percent Cu and 6.5 percent silica.

Molybdenite recovery and concentrate grade-flotation time data for the collectorless flotation process were obtained in other tests in which pine oil (0.06 lb/t), syntex (0.01 lb/t), and sodium silicate (0.3 lb/t) were added in the grinding mill. The results indicate that 81.6 percent of the molybdenite was recovered in a rougher concentrate assaying 14.2 percent $MoS_2$ for a flotation time of 2 minutes and a grind of 35-cumulative weight percent plus 100 mesh. The molybdenite recovery increased to 86.1 and 87.0 percent for a flotation time of 6 and 10 minutes respectively. However, there was a corresponding decrease in rougher concentrate grade to 9.9 and 7.5 percent respectively.

The recovery-flotation time data for the other sulfide-bearing minerals in the same collectorless tests indicate that 1.4, 33.7, 5.2, 27.5, and 3.7 percent of pyrite, copper, lead, zinc, and silver, respectively, were recovered in the rougher concentrate for a flotation time of two minutes. The recoveries of these sulfide-bearing minerals increased with increasing flotation time.

In the prior art selective-flotation process where the molybdenite is selectively floated from the ore while depressing the other sulfide minerals along with the non-sulfide gangue the reagents used in rougher-flotation step are vapor oil, syntex, pine oil, sodium silicate and occasionally sodium cyanide, and Nokes reagent. The rougher concentrate is upgraded in the cleaner circuit to produce regular-grade concentrate. The reagents used in the cleaner circuit are Dowfroth 250, vapor oil, sodium cyanide and Nokes reagent.

Molybdenite recovery and concentrate grade-flotation time data for the vapor-oil rougher flotation test indicate that 89 percent of molybdenite was recovered in the rougher concentrate assaying 13.60 $MoS_2$ for a flotation time of two minutes and a grind of 35-cumulative weight percent plus 100 mesh. The molybdenite recovery in the rougher concentrate increased to 93.0 and 94.4 percent for a flotation time of 6 and 10 minutes respectively. In the vapor oil tests a flotation pulp density of 35% solids was used with 0.66 lb/t vapor oil, 0.06 lb/t pine oil, 0.01 lb/t syntex, 0.3 lb/t sodium silicate and pH8 (adjusted with lime).

The molybdenite recoveries in the aforesaid collectorless rougher flotation were 81.6, 86.1, and 87.0 percent for flotation times of 2, 6, and 10 minutes respectively. Hence, the addition of the collector (vapor oil) results in an incremental recovery over collectorless flotation of 7.4 percent for a flotation time of 2 minutes. The magnitude of increase was similar for 6 and 10 minutes flotation (6.9 and 7.4 percent).

The recovery-flotation time data for the other sulfide-bearing minerals in the tests using vapor oil as collector indicate that 4.7, 24.2, 14.9, 40.8, and 6.0 percent of the pyrite, copper, lead, zinc, and silver, respectively, were recovered in the rougher concentrate for a flotation time of two minutes. The recoveries of these sulfides increased with increasing flotation time.

The results indicate that the "selective" flotation process is considerably less selective for molybdenite than is collectorless flotation. Other sulfides collected with the molybdenite must be removed therefrom before marketable material is obtained. Even though flotation oil may be used in cleaner flotation performed upon the collectorless rougher concentrate, the oil content of the cleaned concentrate will be much lower, e.g., only about 1% to 3%, by weight, than is the case with either selective or bulk-sulfide flotation.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The process for recovering molybdenite from an ore containing the same along with at least one other metal sulfide which comprises wet grinding said ore to produce an ore pulp consisting essentially of ground ore, water and a small amount of frother, subjecting said pulp to froth flotation without a collector to produce a first concentrate containing a major amount of said molybdenite and a tailing containing a minor amount of said molybdenite together with a major amount of said other sulfides, subjecting said tailing to a bulk sulfide froth flotation step with a collector to produce a bulk sulfide concentrate and separating molybdenite from said bulk sulfide concentrate by froth flotation.

2. The process in accordance with claim 1 wherein said bulk sulfide concentrate is upgraded in a cleaner circuit.

3. The process in accordance with claim 1 wherein said ore pulp is subjected to froth flotation at a relatively coarse grind of about 20% to about 40% plus 100 mesh.

4. The process in accordance with claim 1 wherein said first molybdenite concentrate is upgraded in a cleaner circuit.

5. The process in accordance with claim 4 in which the tailing from said cleaner circuit is sent to said bulk sulfide froth flotation step.

6. The process for treating a molybdenite ore to recover molybdenite therefrom which comprises wet grinding said ore to produce an ore pulp consisting essentially of ground ore, water and a small amount of frother, subjecting said pulp to froth flotation without a collector to produce a first concentrate containing a major amount of said molybdenite and a tailing containing a minor amount of said molybdenite together with a major amount of said other sulfides, upgrading said first molybdenite concentrate in a cleaner flotation circuit to produce a product containing at least about 98% $MoS_2$ subjecting said tailing to a bulk sulfide froth flotation step with a collector to produce a bulk sulfide concentrate and separating molybdenite from said bulk sulfide concentrate by froth flotation.

7. The process for treating a molybdenite ore to recover molybdenite therefrom which comprises wet grinding said ore to produce an ore pulp consisting essentially of ground ore, water and a small amount of frother, subjecting said ore pulp to froth flotation without a collector, to produce a first concentrate containing a major amount of said molybdenite and a tailing containing a minor amount of said molybdenite together with a major amount of said other sulfides, subjecting said tailing to a bulk sulfide froth flotation step with a collector to produce a bulk sulfide concentrate and separating molybdenite from said bulk sulfide concentrate by froth flotation, wherein said bulk sulfide concentrate is upgraded in a cleaner circuit followed by a copper-molybdenum separation of the cleaner circuit concentrate to provide a product containing at least about 90% $MoS_2$.

* * * * *